US011297695B2

(12) United States Patent
Hirai et al.

(10) Patent No.: US 11,297,695 B2
(45) Date of Patent: Apr. 5, 2022

(54) DIELECTRIC HEATING DEVICE AND DIELECTRIC HEATING ELECTRODES

(71) Applicant: Mitsubishi Electric Corporation, Tokyo (JP)

(72) Inventors: Akihito Hirai, Tokyo (JP); Eigo Kuwata, Tokyo (JP); Osamu Wada, Tokyo (JP); Kazuhiro Iyomasa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/038,510

(22) Filed: Sep. 30, 2020

(65) Prior Publication Data

US 2021/0014942 A1 Jan. 14, 2021

Related U.S. Application Data

(63) Continuation of application No. PCT/JP2018/018756, filed on May 15, 2018.

(51) Int. Cl.
*H05B 6/54* (2006.01)
*H05B 6/48* (2006.01)

(52) U.S. Cl.
CPC ..... *H05B 6/54* (2013.01); *H05B 6/48* (2013.01)

(58) Field of Classification Search
CPC ... H05B 6/46; H05B 6/48; H05B 6/50; H05B 6/54; H05B 6/60; H05B 6/62; H05B 6/78; H05B 6/82
(Continued)

(56) References Cited

U.S. PATENT DOCUMENTS 2,436,732 A * 2/1948 Rowe ..... H05B 6/78 219/764
2,508,382 A * 5/1950 Gard ..... H05B 6/50 219/779
(Continued)

FOREIGN PATENT DOCUMENTS

GB 794443 A 5/1958
JP 2002-334775 A 11/2002
(Continued)

OTHER PUBLICATIONS

International Search Report issued in PCT/JP2018/018756 (PCT/ISA/210), dated Aug. 7, 2018.
(Continued)

*Primary Examiner* — Hung D Nguyen
(74) *Attorney, Agent, or Firm* — Birch, Stewart, Kolasch & Birch, LLP

(57) ABSTRACT

A dielectric heating device is provided with two or more electrodes, a grounded surface connected to a first electrode, a signal source connected to a second electrode to output a high-frequency signal, a first element interposed serially between the signal source and second electrode, and a second element interposed serially between the grounded surface and first electrode. The first element includes two terminals that electrically connect the signal source and second electrode in a non-contact manner, to cause the high-frequency signal outputted from the signal source to pass through the first element, by using the electric coupling between the two terminals. The second element includes two terminals that electrically connect the grounded surface and first electrode in a non-contact manner, to output, by using the electric coupling between the two terminals, the high-frequency signal outputted from the signal source, to the grounded surface.

7 Claims, 9 Drawing Sheets

(58) Field of Classification Search
USPC ..... 219/764, 767, 774, 778, 779, 780
See application file for complete search history.

(56) References Cited

U.S. PATENT DOCUMENTS

| | | | | | |
|---|---|---|---|---|---|
| 2,723,334 | A | * | 11/1955 | Rambo | H05B 6/62 219/779 |
| 2,727,212 | A | * | 12/1955 | Hagopian | H05B 6/48 333/27 |
| 3,518,396 | A | * | 6/1970 | Wilson et al. | H05B 6/62 219/767 |
| 2005/0098926 | A1 | | 5/2005 | Tamura et al. | |
| 2016/0278170 | A1 | | 9/2016 | Atherton et al. | |
| 2020/0178358 | A1 | | 6/2020 | Atherton et al. | |

FOREIGN PATENT DOCUMENTS

| | | | |
|---|---|---|---|
| JP | 2013-77442 | A | 4/2013 |
| WO | WO 2014/147384 | A1 | 9/2014 |

OTHER PUBLICATIONS

Pecht, "Exploding E-Cigarettes Are a Growing Danger to Public Health", IEEE Spectrum, Feb. 26, 2018, pp. 1-4.
Extended European Search Report for European Application No. 18919096.0, dated Mar. 19, 2021.
European Communication pursuant to Article 94(3) EPC for European Application No. 18919096.0, dated Sep. 15, 2021.

* cited by examiner

DIELECTRIC HEATING DEVICE AND DIELECTRIC HEATING ELECTRODES

CROSS REFERENCE TO RELATED APPLICATIONS

This application is a Continuation of PCT International Application No. PCT/JP2018/018756, filed on May 15, 2018, which is hereby expressly incorporated by reference into the present application.

TECHNICAL FIELD

The present invention relates to a dielectric heating device for sandwiching a heating target between electrodes to heat that target, and dielectric heating electrodes therefor.

BACKGROUND ART

In a dielectric heating device, such a method is employed in which, using two or more electrodes, a heating target is sandwiched therebetween and then, using a signal source, a voltage is applied across the electrodes, thereby heating the heating target.

For example, in Patent Literature 1, a high-frequency dielectric heating device is described which is a device for placing a heating target between opposite electrodes, thereby heating the target, and as for at least one of the electrodes, includes a deformable electrode that has a heat-insulative member and an electrically-conductive film formed on the external surface of the heat-insulative member and that may abut on the heating target.

The high-frequency dielectric heating device can heat the heating target uniformly and in a short time, and suppress local temperature elevation inside and on the surface of the heating target.

CITATION LIST

Patent Literature

Patent Literature 1: Japanese Patent Application Laid-open No. 2013-77442

SUMMARY OF INVENTION

Technical Problem

Recently, devices are becoming widespread that heat heating targets to generate aerosols, for example, aerosols of aroma chemicals, e-cigarettes, and heated-cigarettes. Since the heating targets for the devices are small, the devices are also small in size and are each configured with use of a battery. Accordingly, a problem arises that heating efficiency is reduced due to heat transfer from the heating target through the electrodes and the wiring to a circuit that generates a voltage and to the grounded surface, the heat transfer being conventionally non-problematic in cases where the heating target is large.

With respect also to the foregoing high-frequency dielectric heating device described in Patent Literature 1, when the heating target is small, problems arise that heating efficiency is reduced as described above and that component circuit and battery of the device reach a high-temperature state.

This invention has been made to solve the problems as described above, and an object thereof is, in a small-size dielectric heating device, to suppress reduction of the heating efficiency for the heating target and to prevent components of the dielectric heating device from reaching a high-temperature state.

Solution to Problem

A dielectric heating device according to the invention comprises: two or more electrodes; a grounded surface connected to a first one of the electrodes; a signal source that is connected to a second one of the electrodes, to output a high-frequency signal; a first element that is interposed serially between the signal source and the second electrode, and that includes two terminals which are electrically coupled mutually and without contact with each other to electrically connect the signal source and the second electrode in a non-contact manner, to cause the high-frequency signal outputted from the signal source to pass through the first element, by using the electric coupling between the two terminals; and a second element that is interposed serially between the grounded surface and the first electrode, and that includes two terminals which are electrically coupled mutually and without contact with each other to electrically connect the grounded surface and the first electrode in a non-contact manner, to output, by using the electric coupling between the two terminals, the high-frequency signal outputted from the signal source, to the grounded surface.

Advantageous Effects of Invention

According to the invention, in a small-size dielectric heating device, it is possible to restrain heat from transferring from the heating object through the electrode or the like to the component circuit and the grounded surface, thereby suppressing reduction of the heating efficiency. Further, since heat is restrained from transferring to the component circuit and the grounded surface, it is possible to prevent the component circuit and the signal source from reaching a high-temperature state.

DESCRIPTION OF EMBODIMENTS

Hereinafter, for illustrating the invention in more detail, embodiments for carrying out the invention will be described with reference to the accompanying drawings.

Embodiment 1

Figure 1:
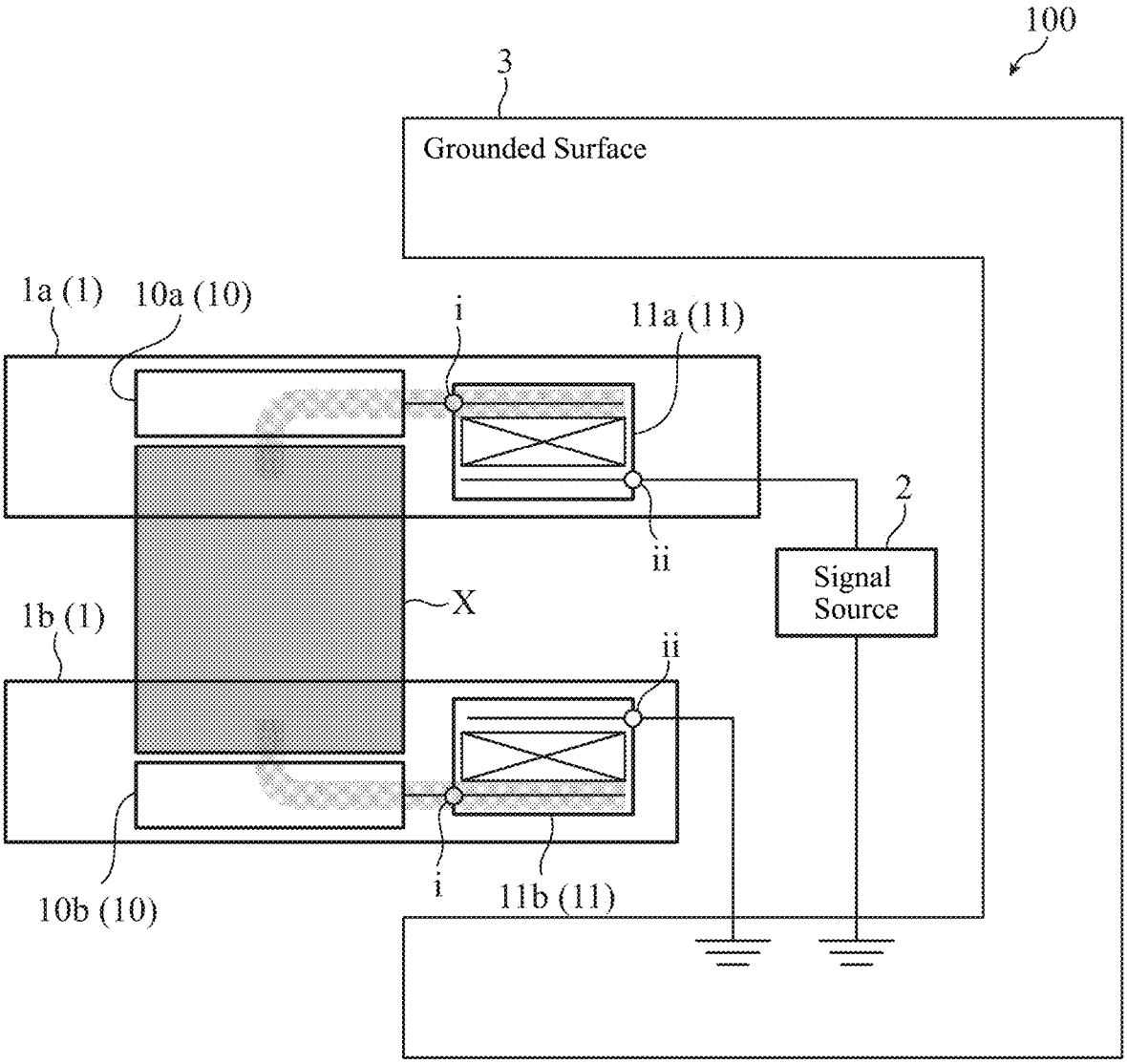
FIG. 1 is a configuration diagram of a dielectric heating device of the invention according to Embodiment 1.

FIG. 1 is a configuration diagram of a dielectric heating device 100 of the invention according to Embodiment 1.

The dielectric heating device 100 is provided as an unbalanced circuit which includes dielectric heating electrodes 1, a signal source 2 and a grounded surface 3 that are each connected by means of unbalanced lines.

The dielectric heating electrodes 1 include electrodes 10 and high-frequency passing heat-insulation elements 11 that cause only a high-frequency signal to pass therethrough and that inhibit heat transfer therethrough. Here, the high-frequency passing heat-insulation elements 11 each have two terminals of a terminal i and a terminal ii. The terminal i and the terminal ii have no metallically-continuous structure, and thus have a structure in which a conductor of the terminal i and a conductor of the terminal ii are not in contact with each other. Further, the terminal i and the terminal ii has a heat-insulation member having a high thermal resistance between the metals of the terminals, so that heat transfer therebetween is suppressed. On the other hand, using electric coupling between the metals, the terminal i and the terminal ii cause only a high-frequency signal to pass therebetween. Note that the two terminals are not metallically continuous and thus have a feature of not allowing a direct-current component to pass therebetween, and specific exemplary devices include a capacitor, a transformer, and a coupler.

Here, for simplification's sake, it is assumed that the coupling degree of electric coupling between the terminal i and the terminal ii is sufficiently high, so that the signal inputted through the terminal i is fully outputted from the terminal ii without being attenuated, and the signal inputted through the terminal ii also is fully outputted from the terminal i without being attenuated. It is further assumed that the thermal resistance between the terminal i and the terminal ii is very high, so that heat entering through the terminal i does not transfer to the terminal ii and heat entering through the terminal ii does not transfer to the terminal i.

Furthermore, in the description of this embodiment, on the assumption that the dielectric heating device 100 is a small-size device, a metal whose area is the largest in the dielectric heating device 100 and is sufficiently larger than areas of the electrodes 10*a*, 10*b*, is assumed to be the grounded surface 3. Accordingly, the heat capacity of the grounded surface 3 is assumed to be large, as a relative value in comparison to the heat capacities of the electrodes 10*a*, 10*b* and a heating target X. On the other hand, since the dielectric heating device 100 is small in size as a whole, the absolute value of the heat capacity of the grounded surface 3 is assumed to be small. The grounded surface 3 may be set appropriately.

With reference to FIG. 1, description will be made about a specific configuration example of the dielectric heating device 100.

The dielectric heating device 100 shown in FIG. 1 includes two dielectric heating electrodes 1*a*, 1*b*, the signal source 2 and the grounded surface 3. With respect to the dielectric heating electrode 1*a*, the electrode 10*a* and the terminal i of the high-frequency passing heat-insulation element (first element) 11*a* are connected to each other by means of metal wiring, and one side of the signal source 2 and the terminal ii of the high-frequency passing heat-insulation element 11*a* are connected to each other by means of metal wiring. With respect to the dielectric heating electrode 1*b*, the electrode 10*b* and the terminal i of the high-frequency passing heat-insulation element (second element) 11*b* are connected to each other by means of metal wiring, and the terminal ii of the high-frequency passing heat-insulation element 11*b* is connected to the grounded surface 3 by means of metal wiring. The other side of the signal source 2 is connected to the grounded surface 3.

When the signal source 2 is turned ON, a high-frequency signal is outputted from the signal source 2. The outputted high-frequency signal is inputted to the terminal ii of the high-frequency passing heat-insulation element 11*a*. The high-frequency passing heat-insulation element 11*a* outputs, from the terminal i, the high-frequency signal inputted through the terminal ii, without attenuating that signal. The high-frequency signal outputted from the terminal i is sent to the electrode 10*a*. The high-frequency passing heat-insulation element 11*b* outputs, from the terminal ii, the high-frequency signal inputted through the terminal i by way of the electrode 10*a* and the electrode 10*b*.

On the other hand, the voltage applied by the electrode 10*a* heats the heating target X, so that the temperature of the heating target X under heating is elevated. When the temperature of the heating target X is elevated, heat generated in the heating target X transfers to the electrodes 10*a*, 10*b*, so that the electrodes 10*a*, 10*b* are heated. Heat in each of the electrodes 10*a*, 10*b* passes through the corresponding metal wiring, thereby heating the terminal i of a corresponding one of the high-frequency passing heat-insulation elements 11*a*, 11*b*. In each of the high-frequency passing heat-insulation element 11*a*, 11*b*, the terminal i and the terminal ii are mutually coupled only electrically, and thus heat transfer between the terminal i and the terminal ii is suppressed, so that the heat does not transfer to the terminal ii-side. Accordingly, at the time the electrodes 10*a*, 10*b* and the high-frequency passing heat-insulation elements 11*a*, 11*b* are heated to reach the same temperature as that of the heating target X, heat transfer from the heating target X does not occur. This makes it possible for the dielectric heating device 100 to efficiently heat the heating target X.

Assuming that the high-frequency passing heat-insulation element 11*a* is not provided in the dielectric heating device 100, heat having transferred from the heating target X to the electrode 10*a* transfers through the signal source 2 to the grounded surface 3. Likewise, assuming that the high-frequency passing heat-insulation element 11*b* is not provided, heat having transferred from the heating target X to the electrode 10*b* transfers to the grounded surface 3, directly. The grounded surface 3 is a metal whose area is the largest in the heating target X and the dielectric heating device 100, and thus the heat capacity of the grounded surface 3 is larger than the heat capacity of the heating target X, so that the heating efficiency is degraded because of heat transfer, namely, because heat in the heating target X transfers through the electrode 10*a* or the electrode 10*b* to the grounded surface 3. In particular, the smaller the sizes of the electrodes 10*a*, 10*b* and the heating target X, the more significant the influence of the heat transfer and the more degraded the heating efficiency of the dielectric heating device 100. Further, although the grounded surface 3 is the largest metal in the dielectric heating device 100, the heat capacity, as the absolute value, of the grounded surface is not large. Thus, in the case where the temperature of the heating target X reaches a high temperature of 100° C. or more, the temperature of the grounded surface 3 itself will also be elevated because of the heat transfer. When heat in the grounded surface 3 transfers to the signal source 2, the temperature of the dielectric heating device 100 as a whole is elevated, so that the lifetime of the dielectric heating device 100 is deteriorated.

In contrast, in the dielectric heating device 100 according to Embodiment 1, the high-frequency passing heat-insulation element 11*a* that causes only the high-frequency signal to pass therethrough and that inhibits heat transfer therethrough, is disposed serially to the electrode 10*a* and the signal source 2; and the high-frequency passing heat-insulation element 11*b* is disposed serially to the electrode 10*b* and the grounded surface 3. This makes it possible to suppress heat transfer to both the signal source 2 and the grounded surface 3 without interrupting transmission of the high-frequency wave, thereby being able to enhance the heating efficiency of the dielectric heating device for the heating target X. In particular, the high-frequency passing heat-insulation element 11*a* suppresses direct heat transfer to the signal source 2 through the electrode 10*a*, thereby preventing temperature elevation of the signal source 2 and preventing heat transfer to the grounded surface 3 through the signal source 2. Further, the high-frequency passing heat-insulation element 11*b* suppresses heat transfer to the grounded surface 3 through the electrode 10*b*, thereby preventing heat transfer to the grounded surface 3. Accordingly, the operation temperature of the signal source 2 as a component circuit can be kept low and thus, the deterioration due to high temperature is suppressed, so that it is possible to prolong the lifetime of the dielectric heating device 100.

It is noted that, in FIG. 1, a case where two dielectric heating electrodes 1*a*, 1*b* are provided is shown as an example; however, the number of the dielectric heating electrodes to be arranged may be set appropriately as long as the number is two or more.

In addition, with reference to FIG. 2 and FIG. 3, description will be made about other configuration examples of the dielectric heating device 100.

Figure 2:
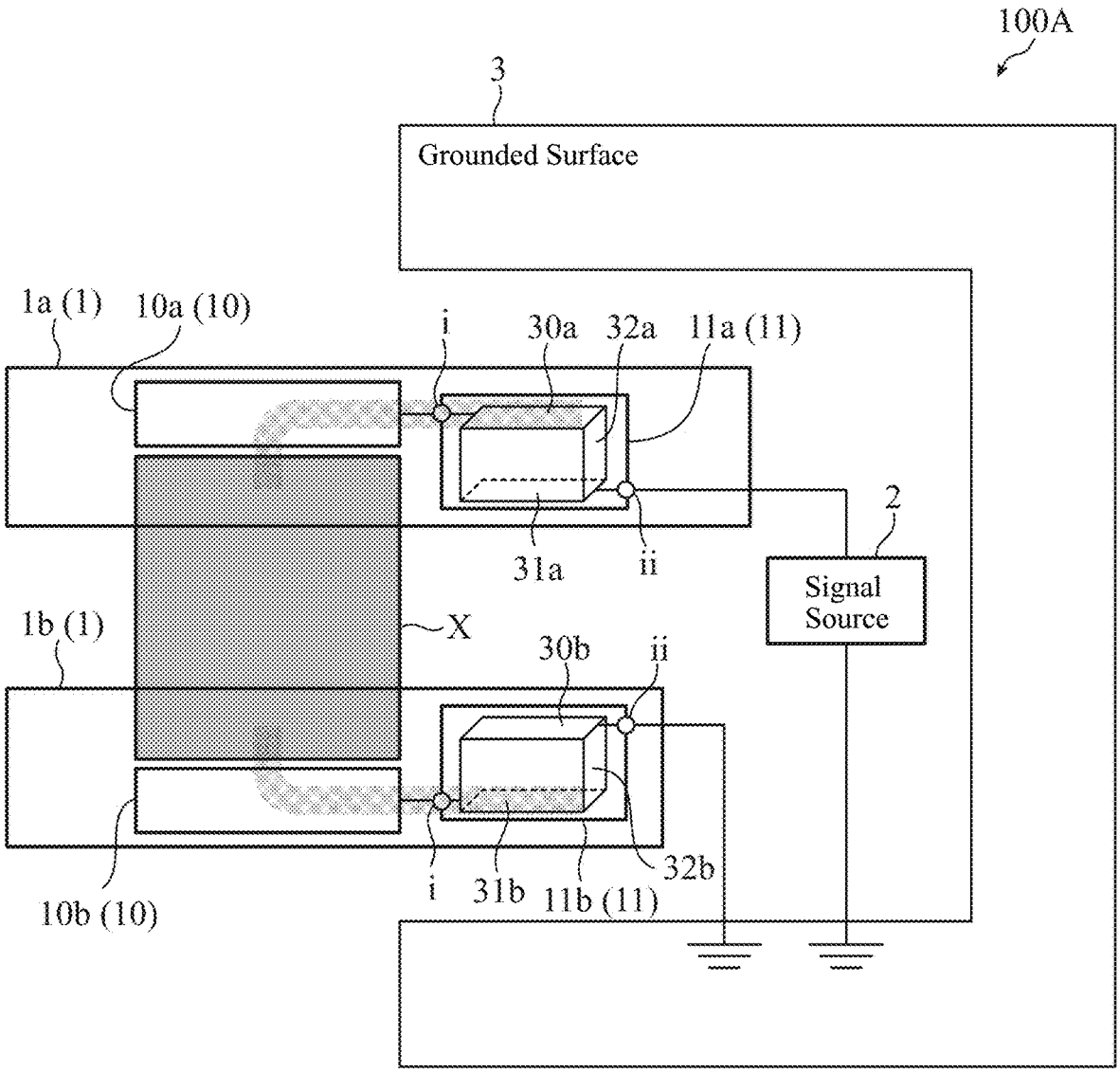
FIG. 2 is a diagram showing another configuration diagram of a dielectric heating device of the invention according to Embodiment 1.
Figure 3:
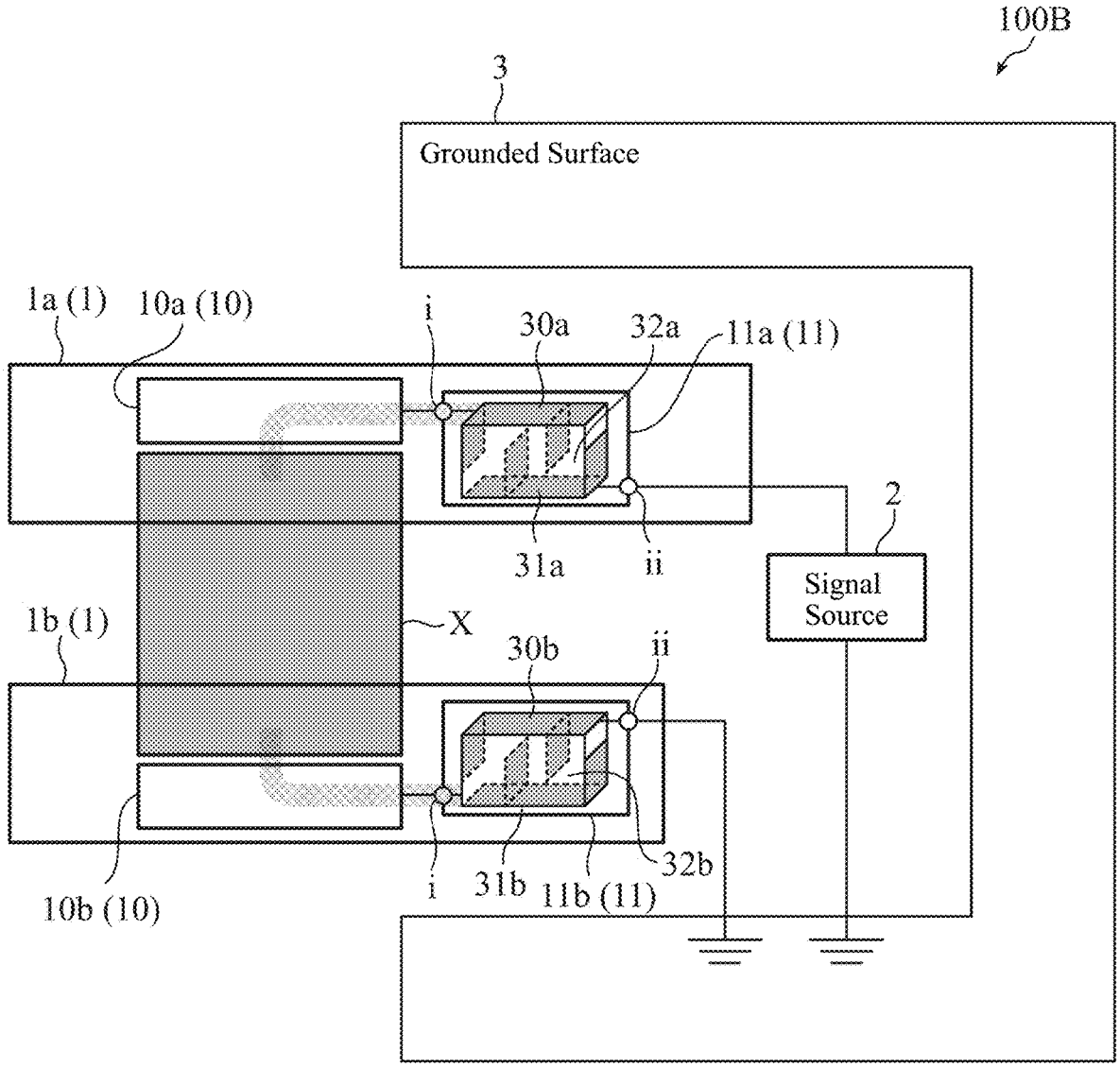
FIG. 3 is a diagram showing another configuration diagram of a dielectric heating device of the invention according to Embodiment 1.

FIG. 2 and FIG. 3 are diagrams each showing another configuration example of a dielectric heating device of the invention according to Embodiment 1.

The high-frequency passing heat-insulation elements 11*a*, 11*b* in a dielectric heating device 100A shown in FIG. 2 each have a structure in which, between two metals, a dielectric material having a high thermal resistance and a high dielectric constant, thereby improving the heat-insulation capability and strengthening the coupling between the terminal i and the terminal ii, so that the high-frequency pass-attenuation characteristic is improved.

The high-frequency passing heat-insulation element 11*a* shown in FIG. 2 includes a capacitor or coupler configured with an element electrode 30*a*, an element electrode 31*a* and a dielectric material 32*a*. The high-frequency passing heat-insulation element 11*b* includes a capacitor or coupler configured with an element electrode 30*b*, an element electrode 31*b* and a dielectric material 32*b*. In each of the high-frequency passing heat-insulation elements 11*a*, 11*b*, the terminal i and a corresponding one of the element electrodes 30*a*, 31*b* are connected together, and the terminal ii and a corresponding one of the element electrodes 31*a*, 30*b* are connected together. In the structure, the dielectric material 32*a* is sandwiched between the element electrodes 30*a*, 31*a*, and the dielectric material 32*b* is sandwiched between the element electrodes 30*b*, 31*b*.

The high-frequency passing heat-insulation elements 11*a*, 11*b* in a dielectric heating device 100B shown in FIG. 3 represent a case where an element electrode 30*a*, an element electrode 30*b*, and element electrodes 31*a*, 31*b* are formed into comb-shaped electrode structures each having multiple projecting portions. The comb-shaped electrode structures are configured in such a manner that the projecting portions of the element electrode 30*a* and the projecting portions of the element electrode 31*a* are placed so that they are engaged alternately, and the projecting portions of the element electrode 30*b* and the projecting portions of the element electrode 31*b* are placed so that they are engaged alternately. Since the high-frequency passing heat-insulation elements 11*a*, 11*b* are provided with the comb-shaped electrode structures shown in FIG. 3, it is possible to increase the electrode areas. Accordingly, electric or magnetic coupling between the element electrode 30*a* and the element electrodes 31*a* and between the element electrode 30*b* and the element electrode 31*b* is enhanced, so that it is possible to obtain small-size high-frequency passing heat-insulation elements 11.

In FIG. 2 and FIG. 3, configuration of the high-frequency passing heat-insulation element 11*a* including two element electrodes 30*a*, 31*a*, and configuration of the high-frequency passing heat-insulation element 11*b* including two element electrodes 30*b*, 31*b* are shown; however, the number of these electrodes may be set appropriately as long as the number is two or more.

As described above, according to Embodiment 1, it is configured to include: two or more electrodes 10*a*, 10*b*; the grounded surface 3 connected to anyone electrode 10*b* of the electrodes; the signal source 2 that is connected to the electrode 10*a* other than the electrode connected to the grounded surface 3, and that outputs a high-frequency signal; the high-frequency passing heat-insulation element 11*a* that is interposed serially between the signal source 2 and the electrode 10*a* connected to the signal source 2, and that causes the high-frequency signal outputted from the signal source 2 to pass through the element 11*a*, by using electric coupling or magnetic coupling between two terminals in the element 11*a*, the terminals being not connected to each other by metal; and the high-frequency passing heat-insulation element 11*b* that is interposed serially between the grounded surface 3 and the electrode 10*b* connected to the grounded surface 3, and that, by using electric coupling between two terminals i, ii in the element 11*b*, outputs the high-frequency signal outputted from the signal source 2, to the grounded surface 3. Thus, it is possible to restrain heat from transferring from the heating object through the electrodes or the like to the component circuit and the grounded surface, thereby suppressing reduction of the heating efficiency. Further, since heat is restrained from transferring to the component circuit and the grounded surface, it is possible to prevent the component circuit and the signal source from reaching a high-temperature state, thereby suppressing deterioration of the component circuit and the signal source due to high temperature, so that prolongation of the lifetime is achieved.

Embodiment 2

Figure 4:
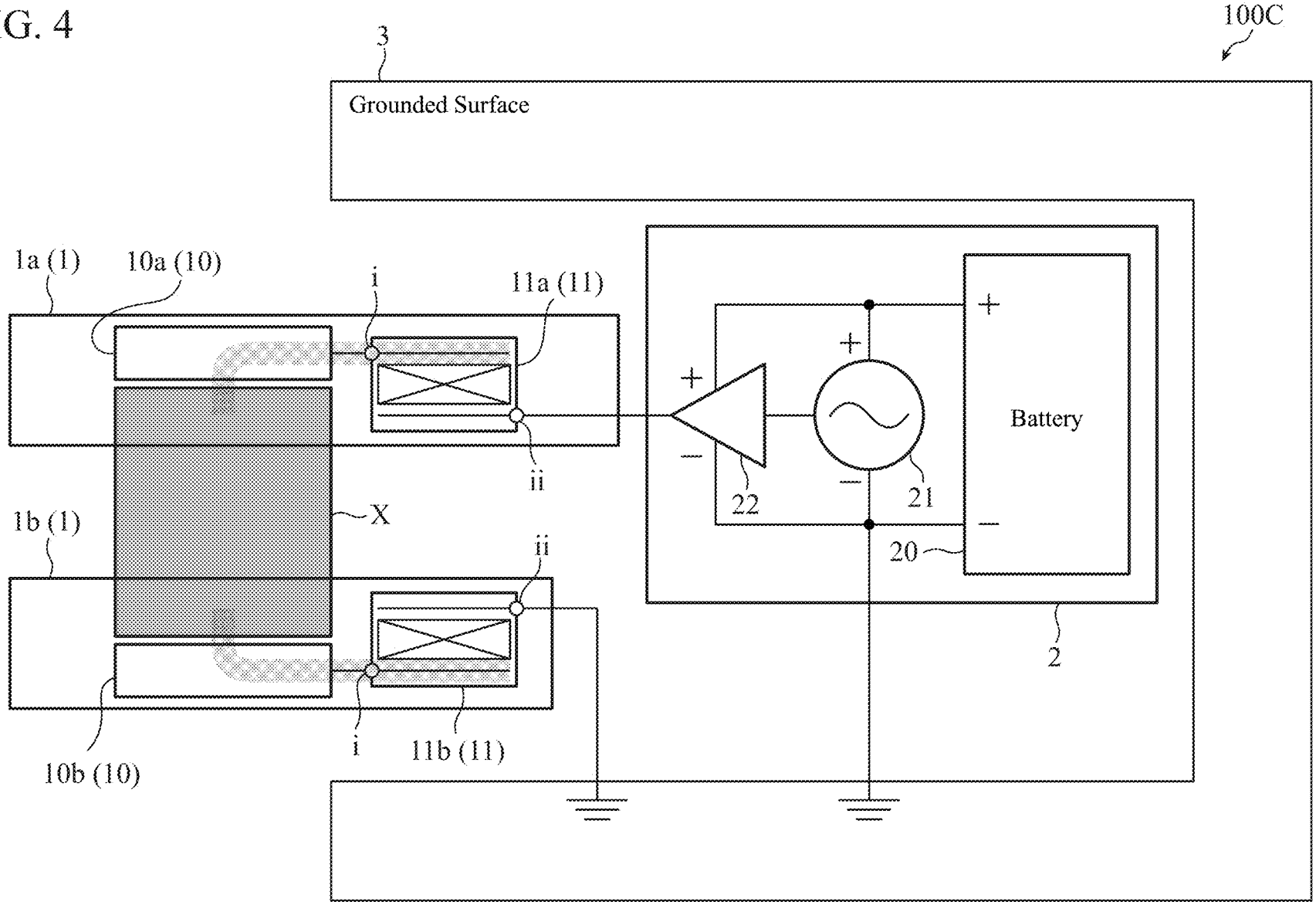
FIG. 4 is a configuration diagram of a dielectric heating device of the invention according to Embodiment 2.

FIG. 4 is a configuration diagram of a dielectric heating device 100C of the invention according to Embodiment 2.

The dielectric heating device 100C of Embodiment 2 corresponds to the dielectric heating device 100 described in Embodiment 1 when the signal source 2 is configured with a battery 20, a signal generator 21 and an amplifier 22.

Note that, in the following, with respect to the parts same as or equivalent to the configuration elements of the dielectric heating device 100 of the invention according to Embodiment 1, the same reference numerals as the reference numerals used in Embodiment 1 are given thereto, and description thereof will be omitted or simplified.

The battery 20 has a plus terminal and a minus terminal and outputs a constant voltage across the plus terminal and the minus terminal. Because of being configured with the battery 20, the dielectric heating device 100C is downsized and thus is portable. The signal generator 21 generates a high-frequency signal. The amplifier 22 amplifies the high-frequency signal generated by the signal generator 21 up to the desired power. The signal source 2 and the amplifier 22 are each connected by means of unbalanced lines, and the amplifier 22 is assumed to be an unbalanced circuit capable of outputting high power.

With respect to the signal generator 21 and the amplifier 22, their respective plus terminals are connected to the plus terminal of the battery 20 and their respective minus terminals are connected to the minus terminal of the battery 20 and to the grounded surface 3. The output of the amplifier 22 is connected to the terminal ii of the high-frequency passing heat-insulation element 11*a*.

Figure 5:
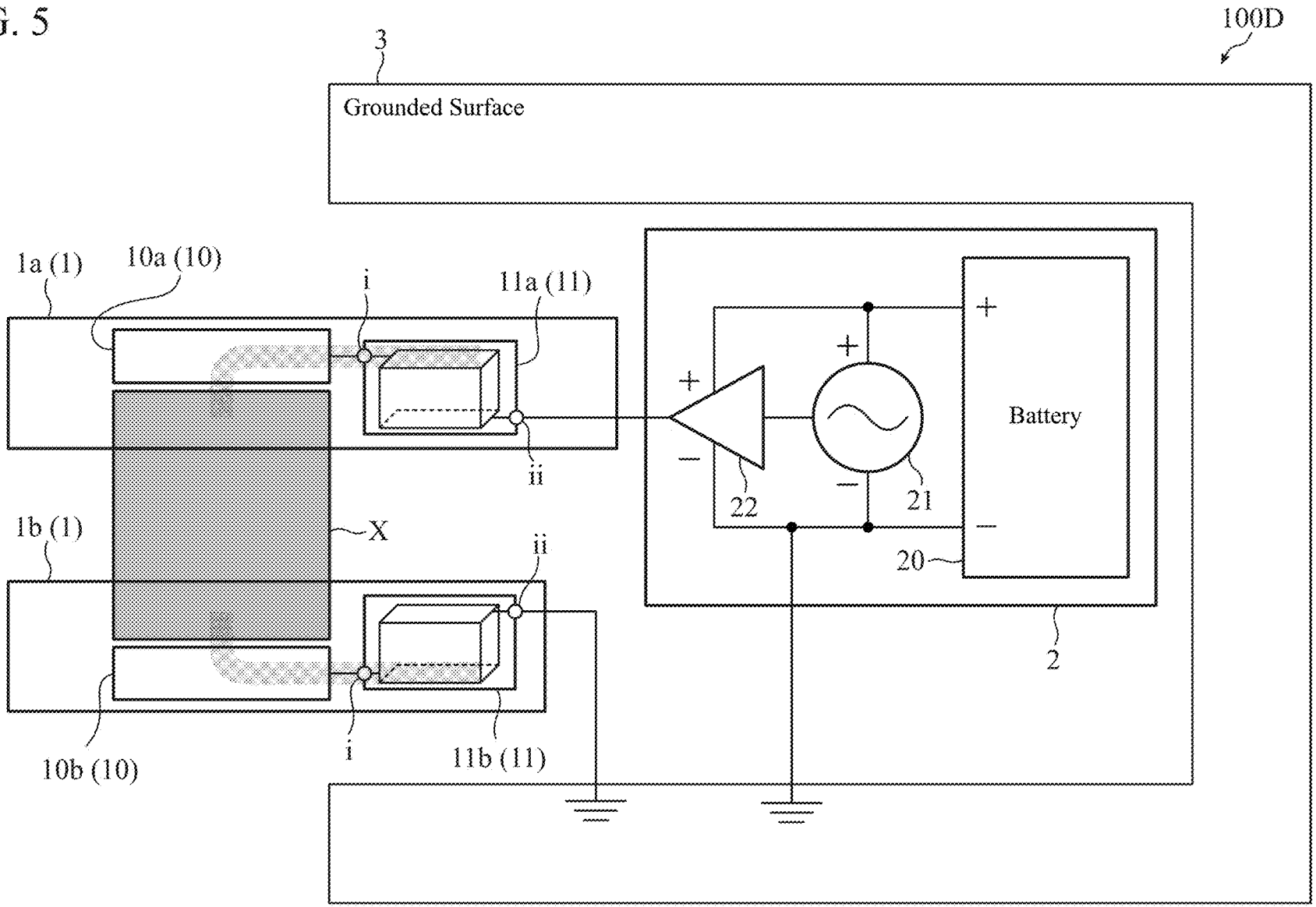
FIG. 5 is a diagram showing another configuration diagram of a dielectric heating device of the invention according to Embodiment 2.

FIG. 5 is a diagram showing another configuration diagram of a dielectric heating device according to Embodiment 2.

A dielectric heating device 100D shown in FIG. 5 represents a case where, in the dielectric heating device 100A of the invention according to Embodiment 1 shown in FIG. 2, the signal source 2 is configured with a battery 20, a signal generator 21 and an amplifier 22.

Further, though not illustrated, in the dielectric heating device 100B of the invention according to Embodiment 1 shown in FIG. 3, the signal source 2 may be configured with a battery 20, a signal generator 21 and an amplifier 22.

According to the configurations shown in FIG. 4 and FIG. 5, it is possible to downsize the dielectric heating device 100C up to a portable size. Further, as has been described in Embodiment 1, although the grounded surface 3 is the largest metal in the dielectric heating device 100, the heat capacity, as the absolute value, of the grounded surface is not large. Thus, in the case where the temperature of the heating target X reaches a high temperature of 100° C. or more, the temperature of the grounded surface 3 itself will also be elevated because of the heat transfer. When heat in the grounded surface 3 transfers to the signal source 2, the temperature of the dielectric heating device 100 as a whole is elevated, so that a possibility arises that the lifetime of the battery is deteriorated or the battery 20 is deformed. According to the embodiment, it is possible to suppress heat transfer from the heating target X to the battery 20 through the electrode 10*a* and the plus terminal or minus terminal connected to the amplifier 22 or the signal generator 21; or heat transfer from the target X to the battery 20 through the electrode 10*b* and the grounded surface 3. This restrains the operation temperature of the battery 20 from being elevated, and thus deterioration of the battery 20 due to high temperature is suppressed, so that it is possible to prolong the lifetime of the battery 20.

As described above, according to Embodiment 2, in the case where the signal source 2 is configured with the battery 20 for outputting a constant voltage, the signal generator 21 for generating a high-frequency signal on the basis of the voltage outputted by the battery 20, and the amplifier 22 for amplifying the high-frequency signal generated by the signal generator 21, it is possible to restrain heat from transferring to the component circuit, that is, the battery, the signal generator and the amplifier. Accordingly, the operation temperatures of the battery, the signal generator and the amplifier can be kept low and thus, it is possible to prevent the battery, the signal generator and the amplifier from being deteriorated in performance due to high temperature or to prevent the component circuit and the battery from being deformed, thereby achieving prolongation of the lifetimes.

Embodiment 3

Figure 6:
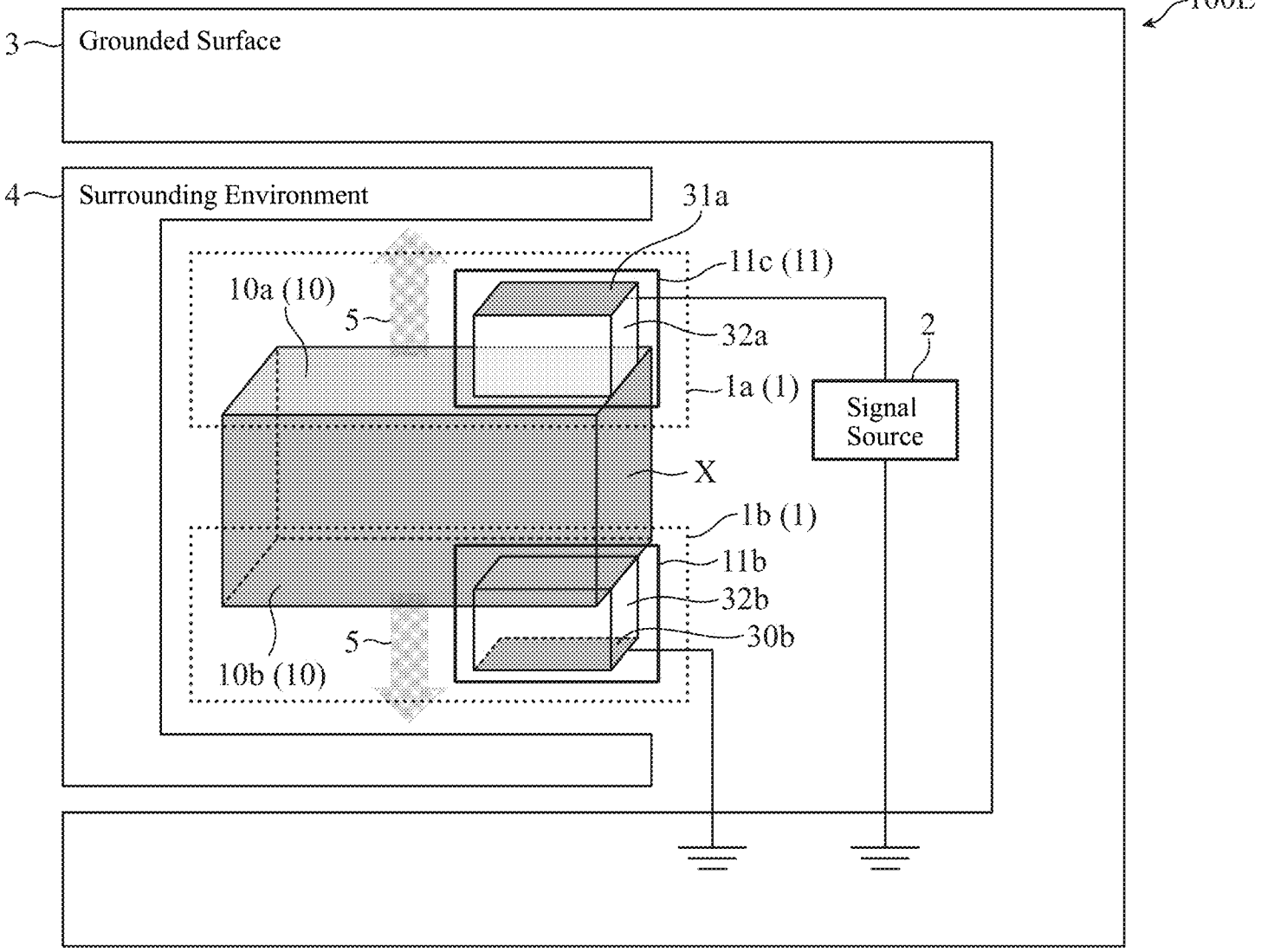
FIG. 6 is a configuration diagram of a dielectric heating device of the invention according to Embodiment 3.

FIG. 6 is a configuration diagram of a dielectric heating device 100D of the invention according to Embodiment 3.

The dielectric heating device 100D of Embodiment 3 has a structure in which the high-frequency passing heat-insulation element 11*c* and the high-frequency passing heat-insulation element 11*b* also served as electrodes for heating the heating target X.

Note that, in the following, with respect to the parts same as or equivalent to the configuration elements of the dielectric heating device 100A of the invention according to Embodiment 1, the same reference numerals as the reference numerals used in Embodiment 1 are given thereto, and description thereof will be omitted or simplified.

An electrode 10*a* and an electrode 10*b* are electrodes for heating the heating target X. Each of the electrode 10*a* and the electrode 10*b* is configured to also serve, partly or wholly, as an electrode for a corresponding one of a high-frequency passing heat-insulation element 11*c* and a high-frequency passing heat-insulation element 11*b*. FIG. 6 shows a case where each of the electrode 10*a* and the electrode 10*b* also serves partly as the electrode for the corresponding one of the high-frequency passing heat-insulation element 11*c* and the high-frequency passing heat-insulation element 11*b*.

In FIG. 6, the dielectric material 32*a* (its surface where the element electrode 30*a* shown in FIG. 2 is to be formed) is made contact with a part of the electrode 10*a*, so that the element electrode 30*a* is configured to serve also as the electrode 10*a*. Further, on an opposite surface of the dielectric material 32*a* to the surface subjected to contact, the element electrode 31*a* is provided, thereby forming the high-frequency passing heat-insulation element 11*c*.

Likewise, the dielectric material 32*b* (its surface where the element electrode 31*b* shown in FIG. 2 is to be formed) is made contact with a part of the electrode 10*b*, so that the element electrode 31*b* is configured to serve also as the electrode 10*b*. Further, on an opposite surface of the dielectric material 32*b* to the surface subjected to contact, the element electrode 30*b* is provided, thereby forming the high-frequency passing heat-insulation element 11*b*.

The element electrode 31*a* is connected to the signal source 2 by means of wiring. The element electrode 30*b* is connected to the grounded surface 3 by means of wiring.

According to the configuration shown in FIG. 6, the wiring between the high-frequency passing heat-insulation element 11*c* and the electrode 10*a* and the wiring between the high-frequency passing heat-insulation element 11*b* and the electrode 10*b* are no longer required, so that the areas of metal surfaces in contact with the heating target X are reduced. Accordingly, it is possible to suppress heat transfer 5 from the metal surfaces to a surrounding environment 4. The surrounding environment 4 means, for example, a surrounding structural object and atmosphere. The heat transfer 5 is indicated in FIG. 6 by an arrow extending from the electrode 10*a* to the surrounding environment 4 and by an arrow extending from the electrode 10*b* to the surrounding environment 4.

Though not illustrated, in the dielectric heating device 100B of the invention according to Embodiment 1 shown in FIG. 3, each of the electrode 10*a* and the electrode 10*b* may be configured to also serve, partly or wholly, as an electrode for a corresponding one of the high-frequency passing heat-insulation element 11*a* and the high-frequency passing heat-insulation element 11*b*.

As described above, according to Embodiment 3, the high-frequency passing heat-insulation element 11*c* includes two or more element electrodes and at least one of the element electrodes serves also as the electrode 10*a*; and the second element includes two or more element electrodes and at least one of the element electrodes serves also as the electrode 10*b*. Thus, it is possible to eliminate the wiring between the high-frequency passing heat-insulation element 11*c* and the electrode 10*a* and the wiring between the high-frequency passing heat-insulation element 11*b* and the electrode 10*b*, thereby reducing narrowly the areas of the metals in contact with the heating target. Further, it is possible to reduce heat transferring from the metal surfaces to the surrounding environment, thereby achieving downsizing of the dielectric heating device.

Embodiment 4

Figure 7:
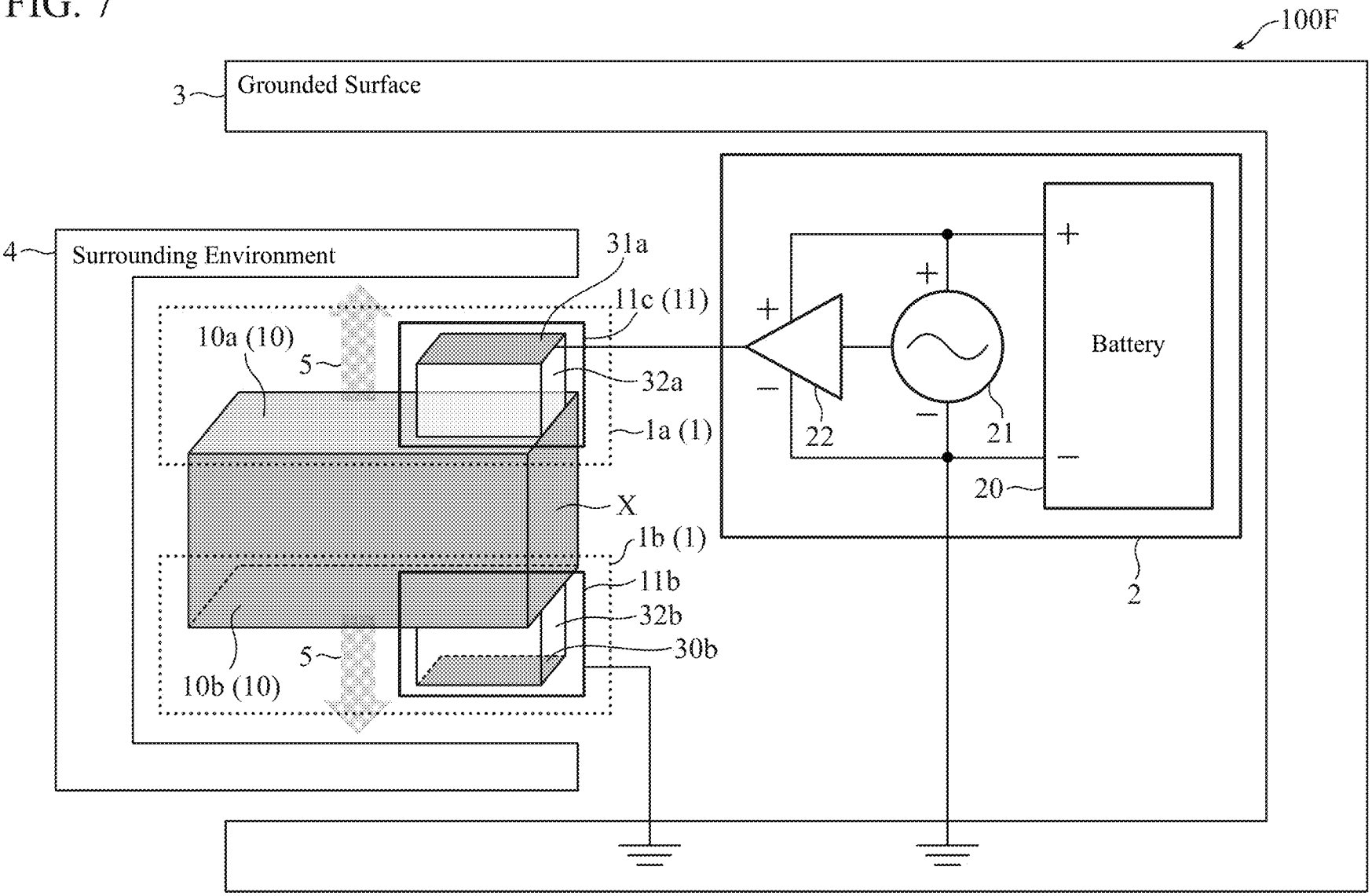
FIG. 7 is a configuration diagram of a dielectric heating device of the invention according to Embodiment 4.

FIG. 7 is a configuration diagram of a dielectric heating device 100F according to Embodiment 4.

The dielectric heating device 100F of Embodiment 4 corresponds to the dielectric heating device 100E described in Embodiment 3 when the signal source 2 is configured with a battery 20, a signal generator 21 and an amplifier 22.

Note that, in the following, with respect to the parts same as or equivalent to the configuration elements of the dielectric heating device 100C of the invention according to Embodiment 2, the same reference numerals as the reference numerals used in Embodiment 2 are given thereto, and description thereof will be omitted or simplified. Likewise, with respect to the parts same as or equivalent to the configuration elements of the dielectric heating device 100E of the invention according to Embodiment 3, the same reference numerals as the reference numerals used in Embodiment 3 are given thereto, and description thereof will be omitted or simplified.

Though not illustrated, in the dielectric heating device 100B of the invention according to Embodiment 1 shown in FIG. 3, it is allowed that each of the electrode 10*a* and the electrode 10*b* is configured to also serve, partly or wholly, as the electrode for a corresponding one of the high-frequency passing heat-insulation element 11*a* and the high-frequency passing heat-insulation element 11*b*, and further the signal source 2 is configured with a battery 20, a signal generator 21 and an amplifier 22.

According to the configuration shown in FIG. 7, the wiring between the high-frequency passing heat-insulation element 11*c* and the electrode 10*a* and the wiring between the high-frequency passing heat-insulation element 11*b* and the electrode 10*b* are no longer required, so that the areas of metal surfaces in contact with the heating target X are reduced. Accordingly, it is possible to suppress heat transfer 5 from the metal surfaces to the surrounding environment 4.

Further, according to the configuration shown in FIG. 7, it is possible to downsize the dielectric heating device 100F. Further, it is possible to suppress heat transfer from the heating target X to the battery 20, thereby restraining the operation temperature of the battery 20 from being elevated to suppress deterioration of the battery 20 due to high temperature, so that it is possible to prolong the lifetime of the battery 20.

As described above, according to Embodiment 4, in the case where the signal source 2 is configured with the battery 20 for outputting a constant voltage, the signal generator 21 for generating a high-frequency signal on the basis of the voltage outputted by the battery 20, and the amplifier 22 for amplifying the high-frequency signal generated by the signal generator 21, it is possible to restrain heat from transferring to the component circuit, that is, the battery, the signal generator and the amplifier. Accordingly, the operation temperatures of the battery, the signal generator and the amplifier can be kept low and thus, it is possible to restrain the battery, the signal generator and the amplifier from being deteriorated due to high temperature, thereby achieving prolongation of the lifetimes.

Further, according to Embodiment 4, the high-frequency passing heat-insulation element 11*c* includes two or more element electrodes and at least one of the element electrodes serves also as the electrode 10*a* on one side; and the second element is configured with two or more element electrodes and at least one of the element electrodes serves also as the electrode 10*b* on another side. Thus, it is possible to eliminate the wiring between the high-frequency passing heat-insulation element 11*c* and the electrode 10*a* and the wiring between the high-frequency passing heat-insulation element 11*d* and the electrode 10*b*, thereby reducing narrowly the areas of the metals in contact with the heating target. Further, it is possible to reduce heat transferring from the metal surfaces to the surrounding environment, thereby achieving downsizing of the dielectric heating device.

The dielectric heating devices 100, 100A, 100B, 100C, 100D, 100E and 100F of the invention according to foregoing Embodiment 1 to Embodiment 4, are each configurable even when the number of the dielectric heating electrodes is three or more.

Figure 8:
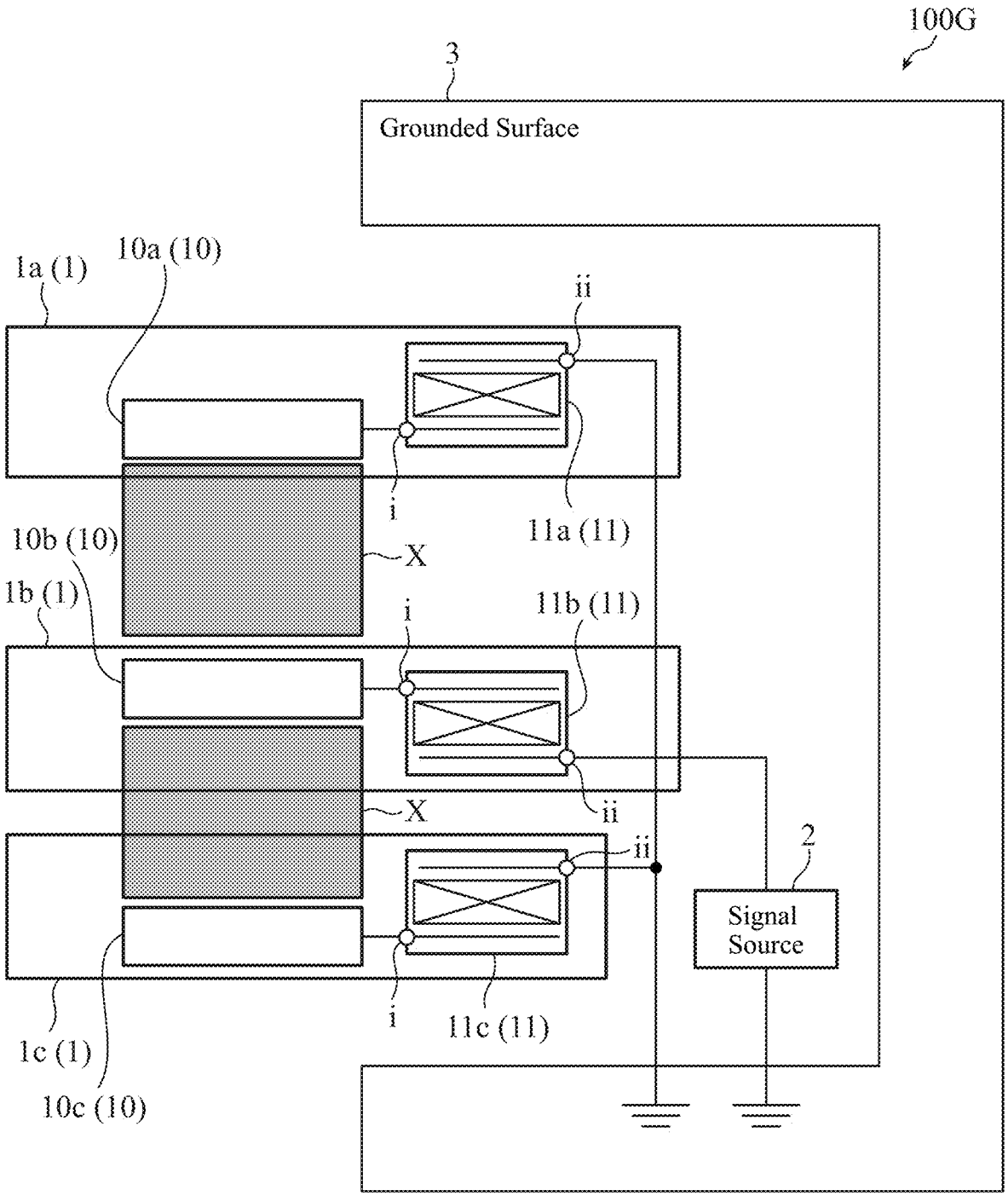
FIG. 8 is another configuration diagram of a dielectric heating device of the invention according to each of Embodiment 1 to Embodiment 4.
Figure 9:
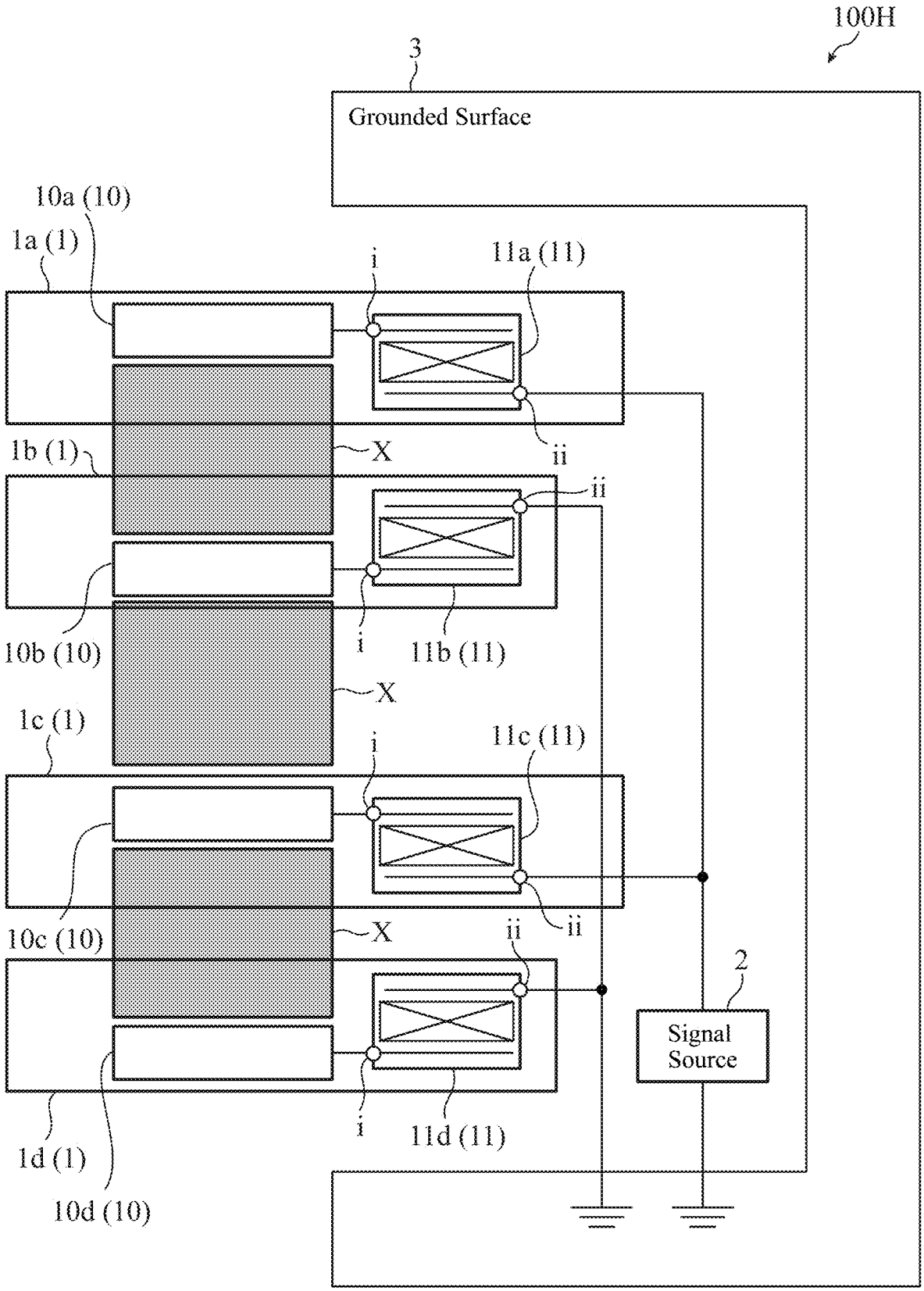
FIG. 9 is another configuration diagram of a dielectric heating device of the invention according to each of Embodiment 1 to Embodiment 4.

FIG. 8 and FIG. 9 are each another configuration diagram of the dielectric heating device of the invention according to any one of Embodiment 1 to Embodiment 4.

In FIG. 8, a dielectric heating device 100G obtained by adding a dielectric heating electrode 1*c* to the dielectric heating device 100 of the invention according to Embodiment 1 shown in FIG. 1, is shown as an example.

In FIG. 9, a dielectric heating device 100H obtained by adding dielectric heating electrodes 1*c* and 1*d* to the dielectric heating device 100 of the invention according to Embodiment 1 shown in FIG. 1, is shown as an example.

Other than the above, unlimited combination of the embodiments, modification of any configuration element in the embodiments and omission of any configuration element in the embodiments may be made in the present invention, without departing from the scope of the invention.

INDUSTRIAL APPLICABILITY

It is particularly preferable that the dielectric heating device according to the invention is used in a portable small-size heating device.

REFERENCE SIGNS LIST

1, 1*a*, 1*b*: dielectric heating electrode, 2: signal source, 3: grounded surface, 4: surrounding environment, 5: heat transfer, 10, 10*a*, 10*b*: electrode, 11, 11*a*, 11*b*, 11*c*, 11*d*: high-frequency passing heat-insulation element, 30*a*, 30*b*, 31*a*,

31*b*: element electrode, 20: battery, 21: signal generator, 22: amplifier, 32*a*, 32*b*: dielectric material, 100, 100A, 100B, 100C, 100D, 100E, 100F, 100G, 100H: dielectric heating device.

The invention claimed is:

1. A dielectric heating device, comprising:

two or more electrodes;

a grounded surface connected to a first one of the electrodes;

a signal source that is connected to a second one of the electrodes, to output a high-frequency signal;

a first element that is interposed serially between the signal source and the second electrode, and that includes two terminals which are electrically coupled mutually and without contact with each other to electrically connect the signal source and the second electrode in a non-contact manner, to cause the high-frequency signal outputted from the signal source to pass through the first element, by using the electric coupling between the two terminals; and a second element that is interposed serially between the grounded surface and the first electrode, and that includes two terminals which are electrically coupled mutually and without contact with each other to electrically connect the grounded surface and the first electrode in a non-contact manner, to output; by using the electric coupling between the two terminals, the high-frequency signal outputted from the signal source, to the grounded surface.

2. The dielectric heating device according to claim 1, wherein the first element includes two or more element electrodes, and at least one of the element electrodes serves also as the second electrode; and wherein the second element includes two or more element electrodes, and at least one of the element electrodes serves also as the first electrode.

3. The dielectric heating device according to claim 2, wherein the signal source includes:

a battery to output a constant voltage;

a signal generator to generate the high-frequency signal on a basis of the voltage outputted by the battery; and an amplifier to amplify the high-frequency signal generated by the signal generator.

4. The dielectric heating device according to claim 1, wherein the signal source includes:

a battery to output a constant voltage;

a signal generator to generate the high-frequency signal on a basis of the voltage outputted by the battery; and an amplifier to amplify the high-frequency signal generated by the signal generator.

5. A dielectric heating; device, comprising:

two or more electrodes;

a grounded surface connected to one of the electrodes;

a signal source that is connected to one of the electrodes other than the electrode connected to the grounded surface, to output a high-frequency signal;

a first element that is interposed serially between the signal source and the electrode connected to the signal source, to cause the high-frequency signal outputted from the signal source to pass through the first element, by using electric coupling or magnetic coupling between two terminals in the first element, the two terminals being not connected to each other by metal; and a second element that is interposed serially between the grounded surface and the electrode connected to the grounded surface, to output, by using electric coupling between two terminals in the second element, the high-frequency signal outputted from the signal source, to the grounded surface, wherein the first element includes two or more element electrodes that are not connected to each other by metal in the first element, and at least one of the element electrodes serves also as the electrode connected to the signal source; and wherein the second element includes two or more element electrodes, and at least one of the element electrodes serves also as the electrode connected to the grounded surface.

6. The dielectric heating device according to claim 5, wherein the signal source includes:

a battery to output a constant voltage;

a signal generator to generate the high-frequency signal on a basis of the voltage outputted by the battery; and an amplifier to amplify the high-frequency signal generated by the signal generator.

7. A plurality of dielectric heating electrodes comprising:

two or more electrodes including a first electrode connected to a grounded surface and a second electrode connected to a signal source to output a high-frequency signal;

a first element that is interposed serially between the signal source and the second electrode, and that includes two terminals which are electrically coupled mutually and without contact with each other to electrically connect the signal source and the second electrode in a non-contact manner, to cause the high-frequency signal outputted from the signal source to pass through the first element, by using the electric coupling between the two terminals; and a second element that is interposed serially between the grounded surface and the first electrode, and that includes two terminals which are electrically coupled mutually and without contact with each other to electrically connect the grounded surface and the first electrode in a non-contact manner, to output, by using the electric coupling between the two terminals, the high-frequency signal outputted from the signal source, to the grounded surface.

* * * * *